United States Patent [19]

Maksim, Jr.

[11] 4,428,728

[45] Jan. 31, 1984

[54] BURNERS FOR SOAKING PIT FURNACES

[76] Inventor: John Maksim, Jr., 8165 Cornwall Ave., Etiwanda, Calif. 91739

[21] Appl. No.: 360,802

[22] Filed: Mar. 22, 1982

Related U.S. Application Data

[63] Continuation-in-part of Ser. No. 293,387, Aug. 17, 1981, which is a continuation of Ser. No. 146,469, May 5, 1980, abandoned, which is a continuation of Ser. No. 850,235, Nov. 10, 1977, abandoned.

[51] Int. Cl.[3] ..... F23C 7/00

[52] U.S. Cl. ..... 431/187; 431/8; 431/181; 432/120

[58] Field of Search ..... 431/187, 181, 284, 285, 431/8; 432/193, 194, 120

[56] References Cited

U.S. PATENT DOCUMENTS

| | | | |
|---|---|---|---|
| 2,480,258 | 8/1949 | Mortson et al. | 431/187 |
| 2,834,407 | 5/1958 | Mason | 431/284 X |
| 3,174,527 | 3/1965 | Reed et al. | 431/181 |
| 3,209,808 | 10/1965 | Conway et al. | 432/193 X |
| 3,217,779 | 11/1965 | Reed et al. | 431/285 |
| 3,411,761 | 11/1968 | Gmell | 431/173 X |

*Primary Examiner*—Edward G. Favors

*Attorney, Agent, or Firm*—Christie, Parker & Hale

[57] ABSTRACT

A burner for soaking pit furnaces produces essentially complete combustion of gas and air mixed in the burner. The burner includes a generally ring-shaped outer housing and a tubular inner ring spaced inside the outer housing to form a hollow annular interior chamber between the inner ring and the outer housing. The outer housing and the inner ring extend above the floor of the furnace. A narrow annular burner opening at the top of the burner is spaced above the floor of the soaking pit furnace. A gas supply pipe in the chamber directs the flow of gaseous fuel under low pressure toward the burner opening.

17 Claims, 3 Drawing Figures

BURNERS FOR SOAKING PIT FURNACES

CROSS-REFERENCE TO RELATED APPLICATIONS

This application is a continuation-in-part of application Ser. No. 293,387, filed Aug. 17, 1981, which is a continuation of application Ser. No. 146,469, filed May 5, 1980, now abandoned which is a continuation of application Ser. No. 850,235, filed Nov. 10, 1977, now abandoned.

FIELD OF THE INVENTION

This invention relates to burners for soaking pit furnaces for steel mills and the like. More particularly, the invention relates to an improvement in a bottom-fired furnace in which a burner extends through the floor of the soaking pit furnace and directs the flame upwardly into the interior of the furnace.

BACKGROUND OF THE INVENTION

Steel ingots produced in steel mills are placed in a soaking pit furnace for heating the ingots to a temperature of about 2400° F. The heated ingots are soaked at that temperature to uniformly heat them throughout until they are malleable enough to be rolled into sheet steel. In a commonly used soaking pit having a prior art burner, it presently takes approximately 2 to 4 hours to heat a steel ingot to a temperature of about 2400° F. and another 4 hours or so to soak the ingot to its malleable condition. U.S. Pat. No. 2,480,255 to Mortson et al illustrates such a conventional burner for bottom-fired soaking pit furnaces. That burner includes an upright gas pipe disposed centrally in a relatively wide airflow channel which surrounds the gas pipe. Air flows upwardly through the airflow channel and mixes with the gas flowing from the pipe. The burner produces a yellow flame, indicating incomplete combustion. The incomplete combustion causes excessive oxide scale buildup on the surface of the steel ingots. The scale acts as a heat insulator which increases the time and energy required to heat up and soak the steel ingots. Moreover, the scale buildup on the ingots reduces the weight of high-grade steel production per ingot. The layer of oxide scale is removed from the ingots after they are soaked and is used in less profitable lower grade steel.

The present invention provides a burner for soaking pit furnaces which produces a continuous clean burning blue flame during use. By avoiding incomplete combustion, the burner of this invention reduces scale buildup on the surface of the ingots. This results in greater production of more profitable higher grade steel per ingot. The flame produced by the burner of this invention also burns hotter, which reduces the amount of time required for the ingots to reach their soaking temperature and to soak at that temperature. The hotter flame also provides a corresponding energy saving, because the amount of gas consumption required to heat each ingot is reduced. Inasmuch as scale buildup is reduced (the scale can act as an insulator), the amount of heat transferred to the ingots by the burner of this invention is increased, which provides an additional saving in heating and soaking time. By reducing soaking time, production of steel ingots can be increased for a given fuel cost. It is estimated that a typical steel mill using the burner of this invention can save several million dollars in production costs per year, when compared with the burners now in use in steel mills in this country.

Further, by avoiding incomplete combustion in the soaking pits, air pollution also is reduced; and the useful life of the soaking pit, burner, and furnace structure is extended.

My previous patent application, Ser. No. 850,235, discloses such a burner for soaking pits in which a continuous, clean-burning blue flame is produced. There is a need to ensure that the flame is constantly maintained adjacent the top of the burner, i.e., without a tendency to blow out or to migrate into the interior of the burner. There is also a need to maximize the amount of surrounding air mixed with the gaseous fuel to avoid incomplete combustion, while, at the same time, producing a more concentrated blue flame.

SUMMARY OF THE INVENTION

According to one embodiment of this invention, a burner for a soaking pit furnace comprises a generally ring-shaped exterior housing having an upper end spaced above the floor of the soaking pit furnace. A tubular inner ring extends through the housing and terminates at an upper end spaced closely apart from the upper end of the housing. This forms an annular chamber between the inner ring and the exterior housing, with a narrow annular burner opening above the chamber, between the top of the inner ring and the top of the exterior housing. An open interior space inside the inner ring can communicate with standing air (absent any appreciable amount of fuel) in an air tunnel below the floor of the furnace. An air supply pipe extends through the interior of the inner ring of the burner. The upper end of the air supply pipe is spaced below the annular burner opening. Air under pressure (absent any appreciable amount of fuel) can flow upwardly through the air supply pipe away from the upper end of the pipe and into the interior of the soaking pit furnace. A gaseous fuel (in the substantial absence of air) supplied to the annular chamber in the burner flows out through the narrow burner opening and away from the upper end of the burner. The flow of air in the air supply pipe is at a greater velocity than the gas flow through the burner opening. The air flow through the pipe creates a low-pressure region inside the interior of the inner ring, drawing standing air in the soaking pit furnace toward the fuel flowing out through the burner opening. The low-pressure region also can draw standing air in the air tunnel into the interior of the inner ring toward the gas flowing through the narrow burner opening. By drawing standing air toward the fuel that flows through the burner opening, the fuel and air are agitated, creating turbulence which mixes the fuel and air to form a fuel-/air mixture which, when ignited, produces a continuous clean-burning blue flame adjacent the top of the burner.

The pressure of air in the low-pressure region inside the burner ring can be controlled, by adjustments provided in the amount of standing air allowed to flow into the interior region of the burner ring from the air tunnel. This can prevent the flame from either being drawn into the burner or from blowing out. The air pressure can be accurately controlled so as to concentrate the blue flame and constantly maintain the flame at the top of the burner, preventing the flame from migrating down into the chamber.

These and other aspects of the invention will be more fully understood by referring to the following detailed description, and the accompanying drawings.

DRAWINGS

DETAILED DESCRIPTION

Figure 1:
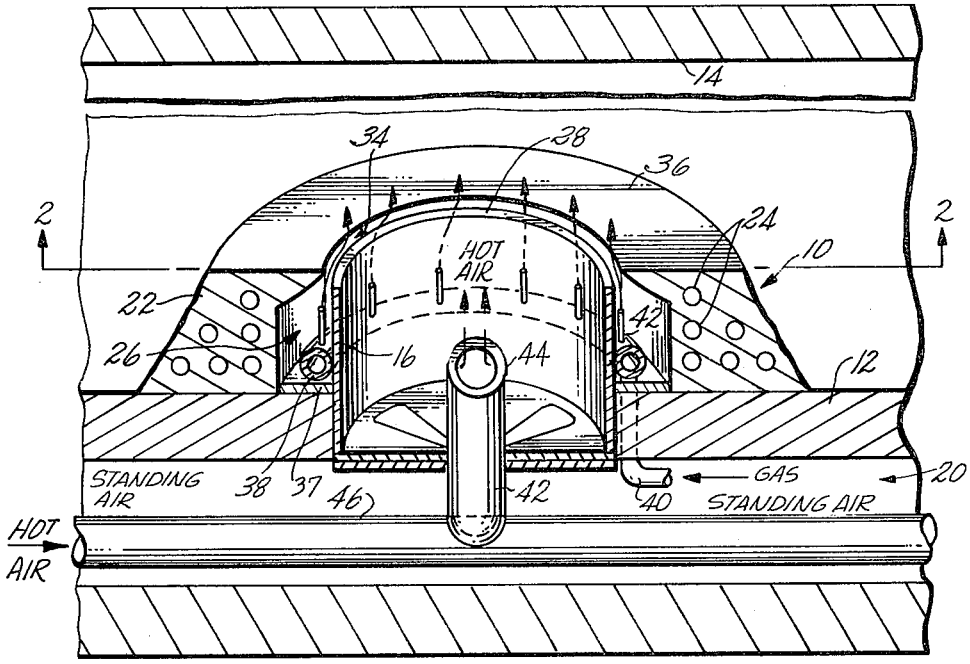
FIG. 1 is a semi-schematic, cross sectional perspective view showing a soaking pit burner according to principles of this invention, the cross sectional view being taken through the center of the burner.
Figure 2:
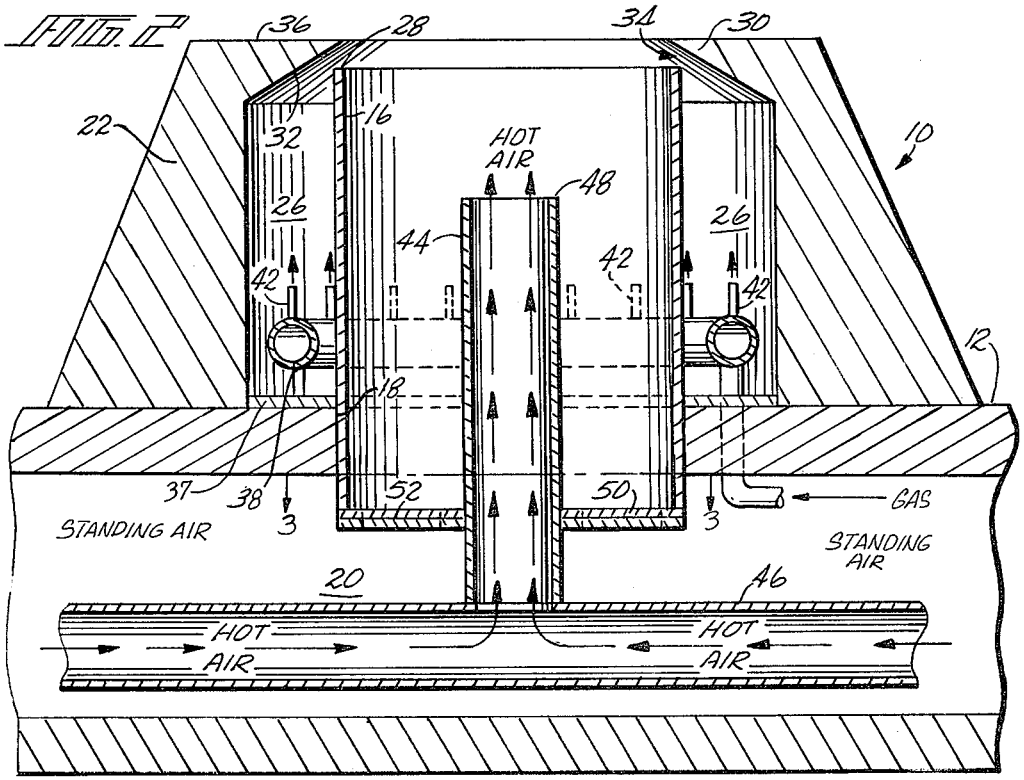
FIG. 2 is a semi-schematic, cross sectional view taken on line 2—2 of FIG. 1.

FIGS. 1 and 2 show a bottom-fired soaking pit furnace having a single burner 10 extending through a floor 12 of the furnace. The furnace also includes upright side walls (not shown) extending above the floor, and a soaking pit cover 14 above the side walls for forming an enclosure which is fired by a flame produced by the burner 10.

The burner includes an upright tubular inner wall or ring 16 extending through a circular opening 18 in the floor of the soaking pit furnace. The interior of the tubular inner ring can communicate with a source of standing air in an air tunnel 20 below the floor of the soaking pit furnace. Standing air (in the substantial absence of air) in the air tunnel can be drawn upwardly through the inner ring, as described below. The air tunnel is shown smaller in size than normal in FIGS. 1 and 2 for simplicity.

A generally ring-shaped exterior housing 22 of the burner extends above the floor of the soaking pit and surrounds the portion of the tubular inner ring 16 which projects above the floor of the soaking pit floor. The exterior housing is made from a heat-resistant material, such as steel. The housing can have embedded water cooling pipes, illustrated schematically at 24. Preferably, the top of the exterior housing is about 2 to 2½ feet above the floor of the furnace. The housing is not merely a protective device to keep scale and the like out of the burner flame. The housing is part of the burner itself. The exterior housing is spaced apart from the tubular inner ring to provide a substantially enclosed annular, hollow, interior chamber 26 between the inner ring and the exterior housing.

The upper interior wall portion of the exterior housing tapers inwardly toward an upper edge 28 of the inner ring to form an annular baffle 30 located above the chamber 26 and surrounding the upper edge of the inner ring 16. An inside edge 32 of the baffle is closely spaced-apart from the upper edge of the inner ring to form a narrow annular burner opening 34 in the upper end 36 of the exterior housing. The narrow burner opening is located immediately adjacent the annular upper edge 28 of the inner ring. The burner opening is separated from the inside surface of the tubular inner ring solely by the thickness of the ring, which in one embodiment is about 1 inch. The burner opening is narrow in relation to the diameter of the tubular inner wall. Preferably, the width of the burner opening is less than about 20% of the diameter of the tubular inner wall. In one embodiment, the inner wall has an inside diameter of about 24 inches, and the width of the narrow burner opening is about ½ to 2 inches.

The baffle portion of the exterior housing covers the top of the hollow chamber 26, and the inside annular edge 32 of the baffle extends a short distance above the top edge of the inner ring, such that the narrow burner opening 34 is actually formed slightly above the upper edge 28 of the inner ring. Thus, the burner opening above the interior of the chamber faces radially inwardly toward the centerline of the tubular inner ring.

A horizontal annular plate or flange 37 surrounds the outer surface of the inner ring. The bottom of the plate rests on top of the furnace floor adjacent the opening 18. The inside of the plate is welded to the outside of the inner ring and the outside of the plate is welded to the inside wall of the exterior housing. In this way, the inner ring and the outer housing are a one piece unit. In addition to providing a support for the unit in the floor, the seat also can act as a gas seal between the chamber 26 and the air tunnel.

An annular gas supply pipe 38 disposed within the chamber 26 surrounds the inner ring 16 of the burner. The annular gas supply pipe is connected to a gas line 40 for supplying a source of gaseous fuel to the interior of the gas supply pipe. The gas supply pipe is located in the bottom portion of the chamber 26, and a plurality of circumferentially spaced-apart upright standpipes 42 on the top of the gas supply pipe are directed generally upwardly toward the narrow annular burner opening 34 above the chamber 26. In one embodiment, the gas supply pipe has a ring diameter of about 32 inches and an inside diameter of about 4 inches.

An elongated upright air supply pipe 44 extends upwardly through the hollow interior of the tubular inner ring along the central axis of the tubular inner ring. The air supply pipe is connected to an air duct 46 located below the burner, preferably in the air tunnel. The flow of air in the air duct is isolated from the air in the air tunnel. The air supply pipe has an upper edge 48 located well below the upper end 28 of the ring of the burner. The upper edge of the air supply pipe is spaced well above the bottom opening of the inner ring of the burner. The outer wall of the air supply pipe is spaced uniformly from the inside wall of the surrounding inner ring of the burner. The cross sectional area of the air supply pipe is substantially less than the cross sectional area within the inner ring of the burner. In the illustrated embodiment, the area within the inner ring is about four times the area within the air supply pipe.

In use, air (in the substantial absence of fuel) is forced under pressure through the air duct 46 so that the air flows upwardly past the upper edge 48 of the air supply pipe 44 and past the narrow annular burner opening 34 and into the furnace. Preferably, hot air is forced through the air supply pipe so as to not reduce the temperature in the furnace. Hot exhaust air from nearby recuperators can supply the hot air to the air supply pipe. The flow of hot air in the air supply pipe is at a pressure substantially greater than the pressure of air in the air tunnel and substantially greater than the pressure of gaseous fuel supplied to the gas supply pipe. Thus, the velocity of air flowing out of the air supply pipe is greater than the velocity of fuel flowing through the burner opening.

Figure 3:
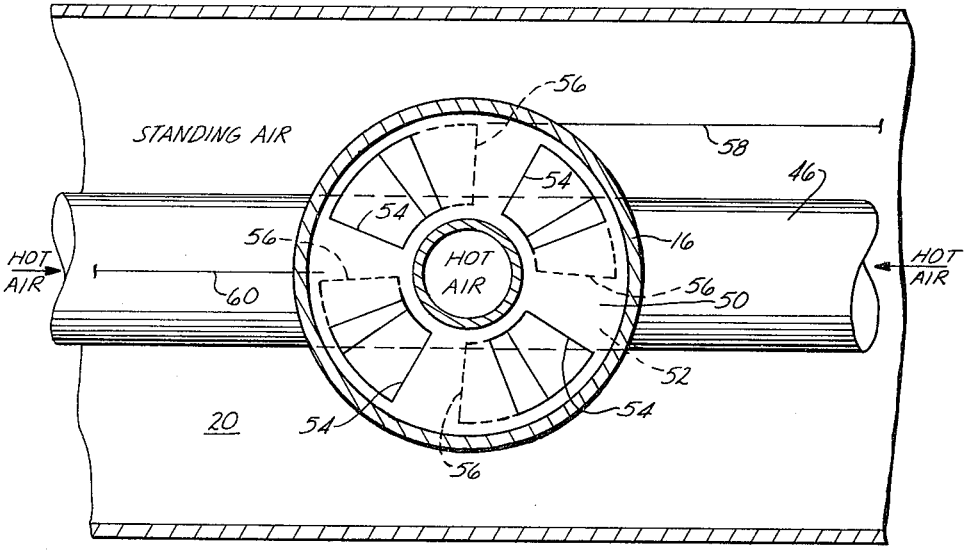
FIG. 3 is a top elevation view, partly in cross section, taken on line 3—3 of FIG. 2 and showing a means for controlling the flow of air into a lower portion of the burner.

The entry of standing air from the air tunnel into the lower interior region of the tubular inner ring is controlled by a disc-like fixed plate 50 and a rotatable vane 52 below the fixed plate 50. The fixed plate 50 is sealed across the opening between the air supply pipe and the inner ring. As shown best in FIG. 3, the fixed plate has circumferentially spaced-apart openings 54, and the rotatable vane has cooperating circumferentially spaced-apart openings 56. A cable 58 attached to the rotatable vane can be used to rotate the vane relative to the fixed plate to adjust the position of the openings in the vane with respect to openings in the fixed plate. Another cable 60 attached to the rotatable vane can be used to rotate the vane in a direction opposite from the cable 58. The openings in the vane can register entirely with the openings in the plate to admit the maximum amount of standing air to the lower region of the inner ring; or the vane can be rotated to position its openings to entirely close off the lower region of the inner ring from the air tunnel; or the openings in the vane can be registered partially with the openings in the plate in varying amounts. In this way, the vane and the fixed plate act as louvers to precisely control the amount of standing air allowed to flow into the lower region of the inner ring from the air tunnel. This controls air pressure in the lower portion of the ring.

In using the soaking pit furnace, ingots (not shown) are placed in the interior of the furnace housing. A gaseous fuel, such as natural gas, or a mixture of natural gas and coke oven gas under low pressure, preferably about 15–20 psi line pressure, is introduced to the gas supply pipe 38 through the gas line 40. The gas flows upwardly through the spaced-apart standpipes 42 toward the narrow annular burner opening 34. The gas flows through a major portion of the chamber 26 inside the burner ring prior to flowing out through the narrow burner opening at the top of the burner. The flow of gas through the chamber produces a laminar, generally uniform, cross sectional flow of gas through the narrow burner opening, generally in the direction of the arrows shown in FIG. 1. Simultaneously, hot air is forced under pressure through the air duct 46 and upwardly through the air supply pipe 44 in the direction of the arrows, shown best in FIG. 2. The hot air flowing through the air supply pipe is forced under pressure at a substantially higher pressure than the pressure of the gaseous fuel in the gas line. Preferably, the air flowing through the air supply pipe has a velocity of two to four times the velocity of the gas that flows out through the narrow annular opening at the top of the burner ring. The baffle 30 reduces the cross section of gas flow prior to the gas flowing out through the burner opening, and this produces a low-pressure region of gas flow which aids in continuously and uniformly drawing gas flow through the narrow opening into the air stream flowing past the narrow opening from the air supply pipe.

The upward flow of air through the air supply pipe creates a low-pressure region within a lower portion of the hollow interior of the inner ring of the burner, below the top of the air supply pipe. The fast moving air creates a lower pressure region around it than the pressure of the standing air. In effect, the burner produces an annular flame with air being blown at a much greater velocity through the center of the flame, leaving a large low pressure area between the flame and the air flow. Standing air tries to replace the air in the low pressure region. Thus, the low pressure region tends to draw standing air from the furnace in the vicinity of the burner into the flow of gaseous fuel from the burner opening. Standing air from the air tunnel also can be drawn into the low pressure region. The flame is forced into the moving air by the low pressure region. The tendency to draw surrounding air toward the flame creates agitation or turbulence of the fuel and the air above the burner, producing a mixing effect resulting in a combustible fuel/air mixture which produces a continuous, clean-burning blue flame. The flame is produced above the top edge of the burner.

The louvers below the inner ring can be opened to accurately control the concentration of the flame. That is, if the louvers are closed, so that no standing air from the air tunnel can flow into the low pressure region inside the burner ring, the flame can have a tendency to move down into the upper portion of the inner ring. By opening the louvers partially, so that the correct amount of standing air can be drawn into the low-pressure region from the air tunnel, the concentration of the flame can be controlled so that a constantly self-sustaining ball of flame is produced above the burner. The air in the air tunnel could be pressurized, if desired, to induce the flow of air through the louvers. The louvers can prevent air flow in the central ring from being so great that the flame will be blown out. They can also control air in the burner ring to prevent the flame from migrating into the burner ring. The fuel pressure, combined with the size of the narrow burner opening and the pressure of air in the low pressure region, cooperate to allow the gaseous fuel to flow out of the burner opening, so that the flame above the burner flutters, rather than producing more of a gas jet stream which has a tendency to blow out. The narrow opening of the burner aids in inhibiting any tendency for pre-ignition to occur within the chamber, and the portion of the baffle which covers the chamber also keeps scale or soot from building up in the interior of the chamber or clogging the gas supply pipe.

By producing a controlled flame adjacent the upper edge of the burner, rather than inside the burner, contact of the hot flame with the burner structure is minimized. This allows use of burner components made of metal, rather than requiring high temperature-resistant refractory materials, such as ceramic. A metal burner can withstand any impact from the heavy steel ingots placed in the soaking pit furnace.

The burner of this invention produces a continuous clean-burning blue flame, which avoids incomplete combustion and greatly reduces scale buildup on the ingots. Such a reduction in scale buildup has been witnessed in comparative tests in which a burner similar to that described herein was used experimentally in a soaking pit in a steel mill, in which the average time required to heat steel ingots to a temperature of 2400° F. was about 1½ hours, as compared with 2–4 hours in a soaking pit using the steel mill's prior art burner described above. The reduced scale buildup results in much greater production of more profitable high grade steel ingot. Since the oxide scale acts as a heat insulator, the amount of heat transferred to the ingots by the burner of this invention is increased, which provides a significant saving in the time required to heat the ingots to their soaking temperature. Further, the blue flame produced by the burner of this invention burns hotter than a yellow flame, which not only reduces the amount of time required for the ingots to reach their soaking temperature, but also reduces the soaking time of the ingots. Thus, more ingots can be soaked during a work shift, which provides a substantial cost savings to the steel mill. The hotter flame also provides a corresponding energy saving because of the amount of gas consumption required to heat each ingot is reduced.

The burner of this invention provides means for precisely controlling the concentration of the blue flame so that the flame burns above the top edge of the burner, not inside the burner. It also prevents the flame from being blown out. The temperature of the flame is so hot that it could melt or seriously weaken a metal burner, if the flame were in constant contact with the metal burner structure during use. However, ignition of the combustible mixture in the present burner does not occur within the mixing chamber surrounding the inner ring of the burner, or in the inner ring itself. Since the flame produced by the burner is above the burner, and not in contact with the burner structure, it allows use of a metal burner structure, rather than requiring the ceramic structure. A metal burner structure is more suitable for use in a bottom-fired soaking pit, in which steel ingots are placed, than a ceramic burner structure, which is susceptible to being broken or cracked as steel ingots are constantly placed in, and removed from, the soaking pit. By producing a flame adjacent the top edge of the burner, there is a need to ensure that the flame will burn continuously and completely, while not being blown out. The present invention ensures that the flame will remain continuously concentrated, with precise control being provided to prevent the flame from migrating or being blown out. By ensuring a concentrated, clean-burning blue flame, heating and soaking time is reduced, which provides the many advantages described above.

I claim:

1. A soaking pit for steel mills and the like, comprising:

a soaking pit furnace having an enclosed area above the floor of the furance;

a burner in the enclosed area of the furnace, the burner having a generally ring-shaped exterior housing, and a tubular inner ring inside the exterior housing and spaced from the housing for forming a hollow annular chamber between the exterior housing and the inner ring, the housing having an upper exterior wall spaced closely apart from an adjacent upper end of the inner ring, forming a narrow annular burner opening above the chamber;

the burner further including an air supply pipe extending through a hollow interior space inside the inner ring of the burner, the air supply pipe having an upper end spaced below the narrow annular burner opening, the air supply pipe being spaced from the surrounding inner ring of the burner and positioned so that air flowing through the air supply pipe is directed toward and past the burner opening and into the furnace;

gas supply means for supplying gaseous fuel to the chamber of the burner ring for causing the fuel to flow through the narrow burner opening and into the furnace above the upper end of the burner;

means for supplying air, in the substantial absence of fuel, to the air supply pipe at a greater pressure than the pressure of gaseous fuel passing through the burner opening, so that the air flowing through the air supply pipe passes upwardly past the burner opening and into the furnace, the pressure of the air in the air supply pipe creating a low-pressure region in the hollow interior space inside the inner ring of the burner for drawing standing air from the hollow interior space inside the inner ring and standing air surrounding the burner toward the gasseous fuel flowing through the burner opening, so that the air mixes with the fuel flowing through the burner opening to form a combustible fuel/air mixture which, when ignited, produces a blue flame adjacent the upper end of the burner.

2. Apparatus according to claim 1 in which the upper ends of the exterior housing and the inner ring are spaced above the floor of the furnace.

3. Apparatus according to claim 1 including means for controlling upward flow of air in the inner ring around the air supply pipe for adjusting the air pressure within the low-pressure region inside the inner ring.

4. Apparatus according to claim 1 including an air tunnel below the floor of the furnace; and means for providing gas communication between the air tunnel and the hollow interior space inside the inner ring of the burner.

5. Apparatus according to claim 4 in which said gas communication is controlled by adjustable louvers for controlling the amount of air passing between the air tunnel and the hollow interior space in the inner ring of the burner.

6. Apparatus according to claim 1 in which the fuel is in substantial absence of air.

7. Apparatus according to claim 6 in which the standing air inside the inner ring is in the substantial absence of fuel.

8. A method for supplying heat to a soaking pit furnace, comprising:

supplying a gaseous fuel to an annular chamber in a burner located in the soaking pit furnace for causing the gaseous fuel to flow from the chamber out through a narrow annular opening at the top of the burner; and forcing air under pressure through an air supply pipe located in a hollow interior space surrounded by the annular chamber, the air being forced out of the air supply pipe at an elevation below the level of the burner opening, the air being also forced through the air supply pipe at a substantially greater velocity than the velocity of the gaseous fuel flowing out of the chamber, the air flowing from the air supply pipe being directed past the burner opening and into the furnace creating a low-pressure region inside said hollow interior space adjacent the air supply pipe, the low-pressure region drawing standing air from the hollow interior space inside the inner ring and standing air from around the burner toward the gaseous fuel flowing through the burner opening for mixing the air with the gaseous fuel to form a fuel/air mixture which, when ignited, produces a blue flame in the furnace immediately adjacent the burner opening.

9. The method according to claim 8 including providing an air tunnel below the burner; and providing gas communication between the air tunnel and the hollow interior space surrounded by the annular chamber.

10. The method according to claim 9 including controlling the amount of air flowing from the air tunnel into said hollow interior space.

11. The method according to claim 8 in which the fuel is in the substantial absence of air.

12. The method according to claim 11 in which the standing air inside the inner ring is in the substantial absence of fuel.

13. The method according to claim 8 in which the gas pressure of the gaseous fuel supplied to the chamber is at about 15–20 psi line pressure.

14. The method according to claim 8 including adjusting upward flow of air in the inner ring around the air supply pipe for controlling the air pressure within the low-pressure region inside the inner ring.

15. Apparatus according to claim 1 in which the velocity of the air is at least about two times greater than the velocity of the fuel passing through the burner opening.

16. Apparatus according to claim 1 in which the burner housing and the inner ring are made of metal.

17. The method according to claim 8 in which the velocity of the air is at least about two times greater than the velocity of the fuel passing through the burner opening.

* * * * *